US006194084B1

(12) United States Patent
Wei et al.

(10) Patent No.: US 6,194,084 B1
(45) Date of Patent: Feb. 27, 2001

(54) THERMAL SPRAY POWDER OF DICALCIUM SILICATE AND COATING THEREOF AND MANUFACTURE THEREOF

(75) Inventors: Xiaohan Wei, Lake Grove; Mitchell R. Dorfman, Smithtown; Luis F. Correa, Hicksville, all of NY (US); Franz Jansen, Winterthur (CH); John Peters, Oberwinterthur (CH)

(73) Assignee: Sulzer Metco Inc., Westbury, NY (US)

( * ) Notice: Subject to any disclaimer, the term of this patent is extended or adjusted under 35 U.S.C. 154(b) by 0 days.

(21) Appl. No.: 09/338,615

(22) Filed: Jun. 23, 1999

(51) Int. Cl.[7] ..... B32B 9/00; B32B 15/00; C04B 35/03; C04B 35/46; C04B 35/48

(52) U.S. Cl. ..... 428/615; 428/621; 428/633; 428/678; 428/680; 428/469; 428/471; 428/472; 501/105; 501/111; 501/135

(58) Field of Search ..... 428/615, 621, 428/633, 678, 680, 469, 471, 472, 472.2, 472.3; 501/105, 111, 135

(56) References Cited

U.S. PATENT DOCUMENTS

| | | |
|---|---|---|
| 3,617,358 | 11/1971 | Dittrich . |
| 4,255,495 | 3/1981 | Levine et al. . |
| 4,450,184 | 5/1984 | Longo et al. . |
| 5,082,741 | 1/1992 | Taira et al. . |

OTHER PUBLICATIONS

F. Xiuji, L. Shizong, Investigation of the Effect of Minor Ions on the Stability of $\beta$–$C_2S$ and the Mechanism of Stabilization, Cement and Concrete Research 16, 587–601 (1986).

G–C.Lai, T. Nojiri, K. Nakano, "Studies of the Stability of $\beta$–$Ca_2SiO_4$ Doped by Minor Ions" Cement and Concrete Research 22, 743–754 (1992).

I.M. Pritts, K.E. Daugherty, "The Effect of Stabilizing Agents on the Hydration Rate of $\beta$–$C_2S$", Cement and Concrete Research 6, 783–796 (1976).

D.K. Smith, A.J. Majumdar, F. Ordway, "Re–Examination of the Polymorphism of Dicalcium Silicate" J. of the American Ceramic Society 44, 405–411 (Aug. 1961).

Montreal Carbide Co. Ltd., Technical Bulletin, MC—$C_2S$ (undated).

Cerac Incorporated, Certificate of Analysis, Calcium Silicate (Oct. 20, 1997).

H. Nakashira, Y. Harada, N. Mifune, "Advanced Thermal Barrier Coatings Involving Efficient Vertical Micro–C-racks", Proceedings of the International Thermal Spray conference, Orlando, Florida, pp 519–523 (May 28—Jun. 5, 1992).

H.E. Schwiete, W. Krönert and K. Deckert, "Existenzbereiche und Stabilisierung von Hochtemperaturmodifikationen des Dicalciumsilicates", Zement–Kalk–Gips, Nr. 9, 359–366 (1968).

*Primary Examiner*—Timothy M. Speer
*Assistant Examiner*—Bryant Young
(74) *Attorney, Agent, or Firm*—Chadbourne & Parke

(57) ABSTRACT

A powder of dicalcium silicate is made by spray drying calcia and silica with incorporation of sodium and phosphorus or stabilized zirconia. The spray dried powder is sintered to form a thermal spray powder. Sprayed coatings have a web of interconnected, randomly oriented microcracks substantially perpendicular to the coating surface. The coatings are stable in thermal cycling and a hot corrosive environment.

12 Claims, No Drawings

THERMAL SPRAY POWDER OF DICALCIUM SILICATE AND COATING THEREOF AND MANUFACTURE THEREOF

This invention relates to thermal spray powders of dicalcium silicate, thermal spray coatings thereof, and a process for manufacturing such powders.

BACKGROUND

Thermal spraying involves the melting or at least heat softening of a heat fusible material such as a metal or ceramic, and propelling the softened material in particulate form against a surface which is to be coated. The heated particles strike the surface where they are quenched and bonded thereto. In a plasma type of thermal spray gun, a high temperature stream of plasma gas heated by an arc is used to melt and propel powder particles. Other types of thermal spray guns include a combustion spray gun in which powder is entrained and heated in a combustion flame, such as a high velocity, oxygen-fuel (HVOF) gun. Thermal spray coatings of oxide ceramics are well distinguished from other forms such as sintered or melt casted by a characteristic microstructure of flattened spray particles visible in metallographically prepared cross sections of coatings.

In one group of thermal spray materials, powders are formed of oxides for spraying coatings that are used for thermal insulation at high temperature such as on burner can surfaces in gas turbine engines. Coatings are also needed for erosion and wear protection at high temperatures, and require resistance against thermal cycle fatigue and hot corrosion in a combustion environment. Zirconium dioxide (zirconia) typically is used in such applications. Because of phase transitions, the zirconia is partially or fully stabilized with about 5% (by weight) 15% calcium oxide (calcia) or 6% to 20% yttrium oxide (yttria). However, these coatings have limitations particularly in resistance to hot corrosion as they allow attack of the substrate or a bond coating Dicalcium silicate ($Ca_2SiO_4$) is a ceramic conventionally used for cement and refractory applications. Excellent hot corrosion and heat resistance of dicalcium silicate based coatings also has been demonstrated in a high temperature combustion environment. However, it is polymorphic with at least five phases including three high temperature $\alpha$ modifications, an intermediate temperature monoclinic $\beta$ phase (larnite) and an ambient temperature $\gamma$ phase. The transformation from the $\beta$ phase to the $\gamma$ phase exhibits a volume increase of 12% leading to degradation in both the thermal spray process and the coatings in thermal cycling. The $\beta$ phase may be retained by quenching or the use of a stabilizer such as sodium or phosphorous. Other suggested stabilizers include oxides (or ions) of sulphur, boron, chromium, arsenic, vanadium, manganese, aluminum, iron, strontium, barium and potassium. At least some of these have also been reported as unsuccessful, and therefore still questionable in stabilizing, including chromium, aluminum, iron, strontium and barium.

U.S. Pat. No. 4,255,495 (Levine et al.) discloses plasma sprayed coatings of thermal barrier oxides containing at least one alkaline earth silicate such as calcium silicate. U.S. Pat. No. 5,082,741 (Tiara et al.) and an article "Advanced Thermal Barrier Coatings Involving Efficient Vertical Micro-Cracks" by N.Nakahira, Y.Harada, N.Mifune, T.Yogoro and H.Yamane, Proceedings of International Thermal Spray Conference, Orlando Fla., May 28–Jun. 5, 1992, disclose thermal spray coatings of dicalcium silicate combined with calcium zirconate ($CaZrO_3$) in a range of proportions.

A commercial powder of $\beta$ phase dicalcium silicate for thermal spraying is sold by Montreal Carbide Co. Ltd., Boucherville CQ, Canada, indicated in their "Technical Bulletin MC-$C_2S$" (undated).

In a chemical analysis the present inventors measured less than 1% by weight of potential stabilizers such as phosphorous in Montreal Carbide powder.

A commercial powder of dicalcium silicate for thermal spraying also is sold by Cerac Inc., Milwaukee, Wis. In a Certificate of Analysis for calcium silicate (Oct. 20, 1997), Cerac reports major $\beta$ phase and low levels of aluminum (0.12%), iron (0.1%) and magnesium (0.25%), and 0.02% or less of other elements.

An object of the present invention is to provide an improved powder of dicalcium silicate for thermal sprayed coatings for thermal barriers having resistance to hot corrosion and sulfidation in a combustion environment. A further object is to provide a novel process of manufacturing such a powder. Another object is to provide an improved thermal sprayed coating of dicalcium silicate for thermal barriers having resistance to hot corrosion and sulfidation in a combustion environment.

SUMMARY

The foregoing and other objects are achieved by a thermal spray powder comprising a substantially uniform powder composition consisting of dicalcium silicate, sodium, a further ingredient selected from the group consisting of phosphorous and zirconium, and incidental ingredients, such that the dicalcium silicate is stabilized in a larnite phase that is majority by volume. In one embodiment the further ingredient comprises phosphorous, in which case, preferably, the sodium recited as disodium monoxide is present in an amount of about 0.2% to 0.8%, and the phosphorous recited as phosphorous pentoxide is present in an amount of about 2.5% to 4%. In another embodiment the further ingredient comprises zirconium, in which case, preferably, the sodium recited as disodium monoxide is present in an amount of about 0.2% to 0.8%, and the zirconium recited as zirconium dioxide is present in an amount of about 10% to 50%. These percentages are by weight of oxide based on the total composition. The zirconium, if present, should be at least partially in the form of zirconium dioxide containing calcium oxide as stabilizer of the zirconium dioxide, or yttrium oxide its stabilizer.

Objectives also are achieved by a process of manufacturing a thermal spray powder of dicalcium silicate having a stabilized crystal structure. An aqueous mixture is formed of calcium carbonate powder, silicon dioxide powder, and an organic binder containing as an integral constituent a stabilizing element in an amount sufficient to stabilize the dicalcium silicate in a larnite phase that is majority by volume. The aqueous mixture is spray dried to form a powder. The spray dried powder is heated, such as by sintering or plasma melting, such that the dicalcium silicate is formed with larnite phase that is majority by volume.

Preferably the stabilizing element is sodium, advantageously contained in an organic binder sodium carboxymethylcellulose. Further advantageously, the aqueous mixture further comprises a compound of phosphorous, preferably as hydrous aluminum phosphate in aqueous solution. Alternatively or in addition to phosphorous, the aqueous mixture further comprises stabilized zirconium dioxide powder with calcia or yttria stabilizer.

Objectives are further achieved by a thermal spray coating of a composition as described above for the powder. The coating has a web of interconnected, randomly oriented microcracks substantially perpendicular to the coating surface. The coating may include a bonding layer of a thermal sprayed nickel or cobalt alloy on a metallic substrate, and an intermediate layer of a thermal sprayed partially or fully stabilized zirconium oxide. The layer of dicalcium silicate composition is thermal sprayed onto the intermediate layer. The intermediate layer blocks reaction between the bonding layer and the layer of dicalcium silicate composition.

DETAILED DESCRIPTION

Dicalcium silicate compositions can be manufactured by agglomeration procedures such as spray drying as taught in U.S. Pat. No. 3,617,358 (Dittrich), incorporated herein in its entirety by reference, followed by sintering (calcination) or melting. Sodium is added as a stabilizing ingredient. A second added ingredient is phosphorous as a stabilizer. Alternatively to the phosphorous, the second additive is stabilized zirconia or, as another alternative, both phosphorous and zirconia may be added. In spray drying a water soluble organic or inorganic binder is used in an aqueous mixture or slurry containing the other ingredients. In a preferred embodiment, the sodium is added by way of containment in the binder formulation, advantageously sodium carboxymethylcellulose (sodium CMC) containing about 2% by weight sodium. Other ingredients and calculated formulae are listed in Table 1 for seven formulations.

TABLE 1

Spray Dry Menu
(Quantities in units of weight)

| Run # | $CaCO_3$ | $SiO_2$ | AP | CZ | YZ |
|---|---|---|---|---|---|
| 1 | 154 | 46 | | | |
| 2 | 150 | 50 | 25 | | |
| 3 | 150 | 50 | 10 | | |
| 4 | 154 | 46 | 25 | | |
| 5 | 154 | 46 | 10 | | |
| 6 | 154 | 46 | | | 33 |
| 7 | 154 | 46 | | 33 | |

AP - $Al(H_2PO_4)_3$, 50% solution.
CZ - $ZrO_2$-5CaO-0.5$Al_2O_3$-0.4$SiO_2$, in weight percents.
YZ - $ZrO_2$-7$Y_2O_3$, in weight percent.

Raw materials were precipitated calcium carbonate ($CaCO_3$, purity 98%, size 1–10 $\mu$m), ground silica ($SiO_2$, purity 99%, 2–15 $\mu$m), hydrous aluminum phosphate (AP), calcia stabilized zirconia (CZ, 98% purity, 0.4–20 $\mu$m) and yttria stabilized zirconia (YZ, 99% purity, 0.4–15 $\mu$m). The amounts of each ingredient are in units of weight, each formulation being in 60 liters of distilled water per unit of weight of the raw materials. The binder is present in an amount of 4% by weight of the raw materials. The $Na_2O$ content was nearly constant around 0.45% as the binder remained constant. A surfactant such as sodium polyacrylate is added in an amount of 2% by weight. The mixture is atomized conventionally with compressed air upwardly through a nozzle into a heated oven region, as described in the aforementioned Dittrich patent and the resulting agglomerated powder is collected.

Table 2 lists powders by lot numbers formulated (some in two sizes) from these compositions. All were subsequently sintered at 1200° C. for 3 hours, except Lot 709 which was treated by feeding through a plasma gun as described in U.S. Pat. No. 4,450,184 (Longo et al.), the portions describing such process being incorporated herein by reference. Table 3 gives chemical compositions (from chemical analyses) and phases (from x-ray diffraction) for eight of the lots.

TABLE 2

Powders

| Lot # | Run # | Size | Additives | Heat Treat |
|---|---|---|---|---|
| 307 | 1 | Std | Na | Sinter |
| 309 | 1 | Fine | Na | Sinter |
| 403 | 2 | Std | Na, P | Sinter |
| 414 | 3 | Std | Na, P | Sinter |
| 429 | 4 | Std | Na, P | Sinter |
| 506 | 5 | Std | Na, P | Sinter |
| 513 | 6 | Std | Na, CZ | Sinter |
| 515 | 6 | Fine | Na, CZ | Sinter |
| 520 | 7 | Std | Na, YZ | Sinter |
| 709 | 1 | Std | Na | Plasma |
| 821 | Blend of Run 1 & CZ 75/25 Wt % | | | |

Std = Standard - predominantly 30 to 125 $\mu$m

Fine - predominantly 22 to 88 $\mu$m.

Na - sodium; P - phosphorous

TABLE 3

Powder Compositions
(Volume Percents)

| Lot # | CaO | $SiO_2$ | MgO | $Al_2O_3$ | $P_2O_5$ | $Na_2O$ | $Y_2O_3$ | $ZrO_2$ | Phases |
|---|---|---|---|---|---|---|---|---|---|
| 307 | 62.23 | 36.28 | 0.42 | 0.29 | 0.03 | 0.49 | | | 100% β |
| 309 | 64.48 | 43.03 | 0.40 | 0.29 | 0.09 | 0.41 | | | 100% β |
| 403 | 56.92 | 33.62 | 0.35 | 1.80 | 6.67 | 0.39 | | | 75% β, CA |
| 414 | 58.83 | 36.66 | 0.37 | 0.89 | 2.73 | 0.42 | | | 75% β, CA |
| 429 | 57.67 | 33.30 | 0.38 | 1.72 | 6.17 | 0.45 | | | 75% β, CA |
| 506 | 61.96 | 32.58 | 0.40 | 0.95 | 3.09 | 0.49 | | | 75% β, CA |
| 513 | 49.19 | 29.09 | 0.33 | 0.47 | 0.01 | 0.40 | 0.04 | 19.71 | 75% β, CZ |
| 515 | 51.04 | 27.63 | 0.33 | 0.47 | 0.01 | 0.41 | 0.03 | 19.25 | 75% β, CZ |
| 520 | 47.37 | 28.84 | 0.28 | 0.42 | 0.02 | 0.40 | 1.53 | 20.62 | 75% β, YZ |

Ca is calcium aluminate, $Ca_3Al_2O_6$.
β - larnite

The powders were thermal sprayed with a Sulzer Metco model F4 plasma gun with a model Twin 10 (TM) powder feeder, using an 8 mm nozzle, argon primary gas at 30 standard liters/minute (slpm) flow, hydrogen secondary gas at 12 slpm, argon powder carrier gas at 3 slpm, 550 amperes, 63 volts, 12 cm spray distance and 3 kg/hr powder feed rate. Several types of substrates included cold rolled steel, Fe-13Cr-44Mo alloy and a Ni alloy of 1.5Co-18Fe-22Cr-9Mo-0.6W-0.1C-max1Mn-max1Si. The substrates were prepared conventionally by grit blasting. Coatings having a thickness of 650 to 730 μm were effected. The finer powders were sprayed with the same gun and parameters except at a spray rate 1.2 kg/hr. Table 4 shows detected phases in the coatings.

TABLE 4

Plasma Sprayed Coating Phases

| Lot/Coating # | Detected Phases |
|---|---|
| 307 | β |
| 309 | β |
| 403 | α ortho |
| 414 | β (+), α ortho |
| 429 | α ortho |
| 506 | β (+) |
| 513 | α ortho, cubic zirconia |
| 515 | α hex, cubic zirconia |
| 520 | α hex, cubic zirconia |
| 709 | β |
| 821 | β, cubic zirconia |

(+) after β designates disordered lattice.

A more important feature of the preferred coatings is a web of interconnected, randomly oriented microcracks substantially perpendicular to the coating surface. Such cracks relieve stresses in thermal cycling. These microcracks were observed particularly in a coating from lot 506 which is stabilized at 75% β phase (larnite) with disodium monoxide and phosphorous pentoxide, and contains aluminum oxide bound with the calcia as $Ca_3Al_2O_6$. However, the x-ray diffraction pattern indicated a disordered lattice. Similar microcracking was observed in a coating from lot 515 containing sodium and calcia stabilized zirconia (CZ). Compositional inhomogeneity was visible in coatings with high amounts of silica or phosphorous (lots 403, 429), and inhomogeneity for lot 414. Lot 429, low in phosphorous, was most uniform. The microcracking is considered to be important for stress relief in thermal cycling. In the coatings, there should be between about 1 and 5 microcracks per $cm^2$ of coating surface.

After a heat treatment at 1200° C. for 48 hours, only three coatings appeared stable against dusting, 506 (low phosphorous) and 515 (CZ), and 414 which completely detached. The only coating to retain the β phase was 506. Coating 515 exhibited a mechanical stable appearance. It is concluded that the coatings that dusted would not be stable in hot environments. Coating 414 was "superstabilized" in a high temperature a phase formed in the heat treatment. A significant amount of calcium zirconate ($CaZrO_3$) was formed in the heat treated coating 515. After a second heat treatment of coatings 506 and 515 at 1300° C. for 48 hours, only the β phase was detected in the coatings. These coatings remained stable.

Further long term cyclic corrosion testing was performed with coatings 414, 506 (both low phosphorous) and 515 up to 900° C., with $V_2O_5$ (85 wt %)/$Na_2SO_4$ (15 wt %) ash as a corrosive agent. These coatings efficiently protected the underlying bond coat and substrate from attack from the agent which did not penetrate the coatings. Reference yttria stabilized zirconia coatings were damaged and partly spalled, and the corrosive agent penetrated the coating.

More broadly, the disodium monoxide should be present in an amount of about 0.2% to 0.8%. If phosphorous pentoxide is the second stabilizer, it should be present in an amount of about 2.5% to 4%. Alternatively, if zirconium dioxide (zirconia) is the second additive, it should be present in an amount of about 10% to 50% by weight. The powder should have a size distribution generally within a range between about 10 and 100 μm. Alternatives to the aluminum phosphate as a raw material are sodium phosphate and zirconium phosphate.

As indicated above for a preferred aspect of the invention, the organic binder for the spray dry process contains the stabilizing element sodium as an integral constituent of the binder compound. More broadly, other stabilizing elements such as potassium or any of the other stabilizing elements set forth above for dicalcium silicate may be used. The stabilizing element is in an amount sufficient to stabilize the dicalcium silicate in a larnite phase that is at least majority or, preferably, substantially fully stabilized larnite.

The powder size distribution generally should be in a range of 10 μm to 200 μm, for example predominantly 30 to 125 μm for thicker coatings or 22 to 88 μm for thinner coatings. The zirconia, when used, should be partially or fully stabilized with about 5% to 15% by weight of calcia or 6% to 20% by weight of yttria. At least some stabilization of the zirconia is desired because some zirconia phase is in the powder particles. Stabilized zirconia is distinguished from calcium zirconate which contains substantially more calcia. Other known or desired stabilizers for the zirconia such as magnesium oxide may be used. In an alternative embodiment, phosphorous is used along with the sodium in powder and coatings containing the stabilized zirconia. Proportions should be the same as for the individual cases.

Plasma gun melting of spray dried powder in place of sintering, is an alternative. Also, lot 821 tested a blend of lot 307 dicalcium silicate with a partially stabilized zirconia powder. Although lot 307 was stabilized only with sodium which was less effective, the testing suggested that powders of the present invention may be blended with other compatible high temperature powders for tailored results. Advantageously, the zirconium oxide is blended in an amount of about 10 to 50% by weight of the total powder, preferably 15% to 25%, for example 20%.

Preferably the dicalcium silicate is applied over a conventional bonding layer of alloy, such as Ni-22Cr-10Al-1.0Y (by weight), or Ni-20Cr or Ni-50Cr, thermal sprayed on an alloy substrate. However, at high temperature the dicalcium silicate may react with the bonding alloy. Zirconia is less prone to such a reaction. Therefore, an advantageous coating is formed of a bonding layer of a thermal sprayed nickel or cobalt alloy on a metallic substrate, and an intermediate layer of a thermal sprayed partially or fully stabilized zirconium oxide. The layer of dicalcium silicate composition is thermal sprayed onto the intermediate layer, the bonding layer being between about 100 μm and 200 μm thick, and the intermediate layer preferably being between about 50 and 200 μm thick. The intermediate layer thereby blocks reaction between the bonding layer and the layer of dicalcium silicate composition.

Applications for the coatings include burner cans, heat shields, blades, vanes and seals in gas turbine engines, rocket nozzles, piston crowns and valve faces in diesel engines, and contast rolls and tundish outlets in steel mills.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. A thermal spray coating on a substrate, the coating comprising a layer of a substantially uniform coating composition consisting of dicalcium silicate, sodium, and a further ingredient selected from the group consisting of phosphorous and zirconium, and incidental ingredients, such that the dicalcium silicate is stabilized in a larnite phase that is majority by volume, and the coating having a coating surface and a web of interconnected, randomly oriented micro cracks substantially perpendicular to the coating surface.

2. The coating of claim 1 wherein the further ingredient comprises phosphorous.

3. The coating of claim 2 wherein the sodium recited as disodium monoxide is present in an amount of about 0.2% to 0.8%, and the phosphorous recited as phosphorous pentoxide is present in an amount of about 2.5% to 4%, the percentages being by weight of oxide based on the total composition.

4. The coating of claim 2 wherein the incidental ingredients comprise aluminum recited as aluminum oxide up to about 2%.

5. The coating of claim 1 wherein the incidental ingredients comprise magnesium recited as magnesium oxide up to about 0.5%.

6. The coating of claim 1 wherein the further ingredient comprises zirconium.

7. The coating of claim 6 wherein the sodium recited as disodium monoxide is present in an amount of about 0.2% to 0.8%, and the zirconium recited as zirconium dioxide is present in an amount of about 10% to 50%, the percentages being by weight of oxide based on the total composition.

8. The coating of claim 6 wherein the zirconium is at least partially in the form of zirconium dioxide containing calcium oxide as stabilizer of the zirconium dioxide.

9. The coating of claim 6 wherein the zirconium is at least partially in the form of zirconium dioxide containing yttrium oxide as stabilizer of the zirconium dioxide.

10. The coating of claim 1 wherein the coating contains between about one and five microcracks per cm of coating surface.

11. The coating of claim 1 wherein the layer of dicalcium silicate composition is between about 50 $\mu$m and 200 $\mu$m thick.

12. The coating of claim 1 further comprising a bonding layer of a thermal sprayed nickel or cobalt alloy on a metallic substrate, and an intermediate layer of a thermal sprayed partially or fully stabilized zirconium oxide, the layer of dicalcium silicate composition being thermal sprayed onto the intermediate layer, the bonding layer being between about 100 $\mu$m and 200 $\mu$m thick, and the intermediate layer being between about 50 $\mu$m and 200 $\mu$m thick, whereby the intermediate layer blocks reaction between the bonding layer and the layer of dicalcium silicate composition.

* * * * *

UNITED STATES PATENT AND TRADEMARK OFFICE

CERTIFICATE OF CORRECTION

PATENT NO. : 6,194,084 B1
DATED : February 27, 2001
INVENTOR(S) : Wei et al.

It is certified that error appears in the above-identified patent and that said Letters Patent is hereby corrected as shown below:

Title page,
Item [73], Assignee: "Sulzer Metco Inc., Westbury, NY (US)" should read as
-- Sulzer Metco (US) Inc., Westbury, NY --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*